US005559853A

United States Patent [19]

Linders et al.

[11] Patent Number: 5,559,853

[45] Date of Patent: Sep. 24, 1996

[54] X-RAY EXAMINATION APPARATUS COMPRISING A FILTER

[75] Inventors: Petrus W. J. Linders; Marcel R. Böhmer; Michael J. M. J. Severens, all of Eindhoven, Netherlands

[73] Assignee: U.S. Philips Corporation, New York, N.Y.

[21] Appl. No.: 497,964

[22] Filed: Jul. 3, 1995

[30] Foreign Application Priority Data

Jun. 3, 1994 [EP] European Pat. Off. ..... 94201884

[51] Int. Cl.[6] ..... G21K 3/00

[52] U.S. Cl. ..... 378/159; 378/156

[58] Field of Search ..... 378/156, 159

[56] References Cited

U.S. PATENT DOCUMENTS

| | | | |
|---|---|---|---|
| 3,755,672 | 8/1973 | Edholm et al. . | |
| 4,497,062 | 1/1985 | Mistretta et al. | 378/158 |
| 5,242,372 | 9/1993 | Carol | 378/159 |

FOREIGN PATENT DOCUMENTS 2600204 12/1987 France .

*Primary Examiner*—Craig E. Church
*Attorney, Agent, or Firm*—Jack D. Slobod

[57] ABSTRACT

An X-ray examination includes a filter for limiting the dynamic range of an X-ray image formed on an X-ray detector by irradiation of an object, for example a patient to be examined, by means of X-rays. The filter has a number of electrodes and grains or powder particles containing an X-ray absorbing material and suspended in a suspension liquid. When a voltage is applied to electrodes, X-ray absorbing material in the suspension will move to the excited electrodes under the influence of electrophoresis. A distribution with a desired X-ray absorption profile is adjusted by application of a suitable voltage pattern. The electrodes may have dimensions of, for example 0.5×0.5 mm, enabling an X-ray absorption profile to be obtained with a high spatial resolution. The X-ray absorption profile can be changed within a brief period of time, for example within one second, by changing the voltage pattern on the electrodes.

20 Claims, 3 Drawing Sheets

X-RAY EXAMINATION APPARATUS COMPRISING A FILTER

BACKGROUND OF THE INVENTION

1. Field of the Invention

The invention relates to an X-ray examination apparatus, comprising a filter which is arranged between an X-ray source and an X-ray detector and which comprises filter members having an adjustable X-ray absorptivity.

2. Description of the Related Art

An X-ray examination apparatus of this kind is known from United States Patent Specification U.S. Pat. No. 3,755,672.

The known X-ray examination apparatus comprises a filter for limiting the dynamic range, being the interval between the extreme brightness values, of an X-ray image. An X-ray image is formed on the X-ray detector by positioning an object, for example a patient to be examined, between the X-ray source and the X-ray detector and by irradiating the object by means of X-rays emitted by the X-ray source. If no steps are taken, the dynamic range of the X-ray image may be too large. On the one hand, the X-ray transmittance of some parts of the object is high, for example that of lung tissue; on the other hand, other parts of the object, such as bone tissue, can hardly be penetrated by X-rays. When lead flaps are used to intercept parts of the X-ray beam emitted by the X-ray source in order to shield parts of the object to be examined from the X-rays, the lead flaps are imaged with a uniform, very low brightness. If no further steps are taken, therefore, an X-ray image with a large dynamic range is obtained whereas, for example medically relevant information in the X-ray image is included in brightness variations in a much smaller dynamic range. When the range of brightness values containing medically relevant information is much smaller than the dynamic range of an X-ray image, the X-ray image cannot be readily processed into an image suitable for use as a diagnostic tool. This problem is encountered, for example the X-ray detector is formed by an image intensifier/pick-up chain comprising an image intensifier tube for convening an incident X-ray image into a light image and a video camera for deriving an electronic image signal from the light image. From areas of very high and very low brightness in the X-ray image there are formed areas of very high and very low brightness in the light image. If no further steps are taken, the dynamic range of the light image may exceed the range of brightness values that can be handled by the video camera without causing disturbances in the electronic image signal.

The filter of the known X-ray examination apparatus limits the dynamic range of the X-ray image. To this end the filter comprises a chamber filled with an X-ray absorbing liquid and covered by a movable membrane. The local thickness of the liquid layer in the chamber can be adjusted by means of drive wires which are attached to the membrane and whereby the membrane is locally depressed or lifted. Wherever the membrane is depressed, the local thickness of the liquid layer is reduced and the local X-ray absorptivity of the liquid layer is reduced accordingly; wherever the membrane is lifted, the local thickness of the liquid layer is increased and its local X-ray absorptivity is increased. The chamber areas in which the thickness of the liquid layer can be adjusted constitute the adjustable filter elements. The membrane movement is controlled by servomotors which drive the drive wires. The servomotors are controlled by signals which correspond to local brightness values in the X-ray image or in the X-ray beam. The servomotor control ensures that the drive wires adjust the membrane in such a manner that in parts of the X-ray beam traversing transmissive parts of the object filter elements are adjusted to a high X-ray absorptivity by locally lifting the membrane and that in parts of the X-ray beam which traverse impervious parts of the object, or are intercepted by a lead flap, filter elements are adjusted to a low X-ray absorptivity by locally depressing the membrane.

The filter of the known X-ray apparatus has the drawback that upon local depression and lifting of the membrane the surrounding area of a depressed or lifted part is also depressed or lifted. As a result, local attenuation of the X-ray beam with a high resolution, i.e. with variations of the X-ray absorptivity over very short distances within a cross-section of the X-ray beam, is not possible. A further drawback of the filter of the known X-ray examination apparatus consists in that the membrane is mechanically driven; this precludes fast movements so that a rather long period of time, i.e. several or even some tens of seconds, is required to switch over the setting of the filter. Therefore, the known X-ray apparatus is not suitable for forming a series of X-ray images in rapid succession because in that case the setting of the filter must be changed every time between the successive X-ray images.

SUMMARY OF THE INVENTION

It is inter alia an object of the invention to provide an X-ray examination apparatus with a filter which is suitable for locally attenuating the X-ray beam with a high resolution. It is also an object of the invention to provide an X-ray examination apparatus with a filter whose setting can be changed within a brief period of time.

To this end, an X-ray examination apparatus according to the invention is characterized in that the filter comprises X-ray absorbing bodies which can be influenced by an electric field adjusted by means of an adjusting circuit.

The electric field adjusted by the adjusting circuit influences the X-ray absorbing bodies in such a manner that under the influence of electrophoresis X-ray absorbing bodies collect in filter elements adjusted to a high X-ray absorptivity and that X-ray absorbing bodies leave filter members adjusted to a low X-ray absorptivity. The electric field strength varies over short distances within the filter, so that the number of X-ray absorbing bodies collected by electrophoresis varies substantially over such short distances, for example one or a few min. The pans of the filter wherebetween the numbers of collected X-ray absorbing bodies differ significantly constitute the filter members whose smallest dimensions are small. The filter according to the invention locally attenuates the X-ray beam with a high resolution at the scale of a few mm.

Because no macroscopic, mechanically movable pans are involved but only locally collected numbers of X-ray absorbing bodies or particles which are displaced over short distances, being a part of approximately the distance between two adjacently situated filter members, the adjustment of the X-ray absorptivities of the filter members can be changed within a very short period of time, for example within one or a few seconds. The adjustment of the filter members is changed by changing the adjusted electric field. Switching over to other voltages requires very little time, for example a few milliseconds. Subsequently, numbers of X-ray absorbing bodies collected in filter members change under the influence of electrophoresis until a new filter setting is reached. The X-ray absorbing bodies contain a material which significantly absorbs X-rays; preferably, lead oxide glass grains or lead sulphide glass grains are used. However, uranium oxide or cerium oxide are also suitable for the absorption of X-rays.

The adjusting circuit adjusts the electric field so as to adjust the filter in conformity with the kind of X-ray image and the circumstances in which it is formed. The adjusting circuit may be provided, for example with a number of selector switches which are operated by the user, for example a radiologist or his/her assistant. The various selector switches relate, for example to various brightness variation patterns occurring, when different parts of the body of a patient are imaged. For example, the imaging of the heart or coronary vessels and peripheral pans of the body requires different filter settings. The radiologist can select a desired filter setting via the selector switches, after which the adjusting circuit controls the electric field in such a manner that the filter reaches the correct setting within a brief period of time. The adjusting circuit furthermore is arranged, for example to derive the adjustment of the electric field from settings of the X-ray source, such as the high voltage and anode current with which the X-ray source operates.

A preferred embodiment of an X-my examination apparatus according to the invention is characterized in that the adjusting circuit is arranged to adjust the filter members for X-ray absorptivities for which brightness values of an X-ray image detected by the X-ray detector and formed by irradiating an object by means of an X-ray beam emitted by the X-ray source are within a predetermined range. By adjusting the filter in such a manner that in parts of an X-ray beam from the X-ray source which traverse transmissive parts of the object filter elements are adjusted to a high X-ray absorptivity, whereas in parts of the beam which traverse impervious parts of the object, or are intercepted by a lead flap, filter elements are adjusted to a low X-ray absorptivity, it is achieved that the brightness variations of the X-ray image are within a predetermined range. Said predetermined range is preferably chosen in conformity with the range of brightness variations representing medically relevant information. The X-ray image with brightness variations in a predetermined, limited range is suitable to derive an image having a high medical diagnostic quality therefrom. This predetermined range is chosen, for example in conformity with the range of brightness values of a light image, derived from the X-ray image, which can be handled by a video camera of an image intensifier/pick-up chain without causing disturbances in the electronic image signal supplied by the video camera.

A further preferred embodiment of an X-ray examination apparatus according to the invention is characterized in that the adjusting circuit is arranged to derive the adjusted electric field from the brightness values of an X-ray image detected by the X-my detector.

The adjusting circuit adjusts the electric field in conformity with the type of X-ray image and the circumstances in which it is formed. For example, the X-ray detector supplies the adjusting circuit with an image information signal containing image information and/or brightness values of the X-ray image formed on the X-ray detector. This image information signal notably contains information concerning areas in which the image brightness is not within a desired dynamic range; the adjusting circuit is controlled thereby in such a manner that the electric field is adjusted to adjust the X-ray absorptivities of the filter members to values for which the entire image brightness is within said dynamic range.

An X-ray examination apparatus according to the invention requires little time, i.e. one or a few seconds, to change the setting of the filter; this setting is based on image information and/or brightness values. In the case of motion of or in a patient to be examined, the filter setting is automatically adapted because, should the X-ray image change due to motion of the patient during irradiation, the adjusting circuit changes the setting of the filter. These motions are, for example cardiac motions or motions caused by respiration. The adverse effect of such motions on the quality of the X-ray image remains limited because the filter setting is adapted.

A further preferred embodiment of an X-ray examination apparatus according to the invention is characterized in that the adjusting circuit is also arranged to adjust an erasure field whose polarity opposes that of said adjusted electric field.

The erasure field is applied for a brief period of time, for example a part of a second. During application of the erasure field, X-ray absorbing bodies initially collected in filter members leave the filter members and all filter members are adjusted to a low X-ray absorptivity within a brief period of time, the setting of the filter thus being erased. An advantage of the use of the erasure field consists in that, after erasure of the filter, it is immediately available again for adjustment to a new setting. As a result of the application of the erasure field, the time required to change the filter setting is reduced, in comparison with the changing of its setting without prior erasure.

A further preferred embodiment of an X-ray examination apparatus according to the invention is characterized in that the filter contains electrically charged X-ray absorbing bodies in an X-ray transparent medium. Because the X-ray absorbing bodies have an electric charge, they can be influenced by the adjusted electric field. Under the influence of the electric field, the X-ray absorbing bodies are displaced and collected in filter members adjusted to a high X-ray absorptivity. The X-ray absorbing bodies are displaced in a medium which is X-ray transparent and which does not attenuate the X-ray beam or only hardly so. The X-ray transparent medium contains an electric charge which opposes the electric charge of the X-ray absorbing bodies. The X-ray transparent medium thus also acts as an electrically neutralizing background which keeps the filter electrically neutral. The X-ray absorbing bodies preferably constitute a colloidal, chemically stable suspension in conjunction with the X-ray transparent medium.

A further preferred embodiment of an X-ray examination apparatus according to the invention is characterized in that the X-ray absorbing bodies are provided with a coating in order to stabilize a suspension of the X-ray absorbing bodies in the X-ray transparent medium.

The grains of, for example lead oxide glass or lead sulphide glass constituting the X-ray absorbing bodies, are added to a suspension liquid which acts as the X-ray transparent medium. In order to ensure that the grains form a colloidal chemically stable suspension in conjunction with the suspension liquid, they are provided with a coating. The colloidal chemically stabilization results from interaction between the material of the coating and the suspension liquid, so that the colloidal chemical stabilization is independent of the X-ray absorbing material. Practically all X-ray absorbing materials can thus be used for the X-ray absorbing bodies, because a suitable coating provided on the X-ray absorbing bodies makes them suitable to form a stable suspension in a suspension liquid. For example, lead oxides or lead sulphides with a coating of, for example an ethyl phosphate surfactant are suitable to form a colloidal chemically stable suspension in a suspension liquid such as isopropanol.

Furthermore, the combination of density and thickness of the coating is preferably chosen so that the mean density of the X-ray absorbing bodies provided with the coating is equal or substantially equal to the density of the suspension liquid. As a result, the X-ray absorbing bodies are suspended in the suspension liquid so that settling out in the suspension is counteracted to a substantial degree.

A further preferred embodiment of an X-ray examination apparatus according to the invention is characterized in that the X-ray transparent medium contains an additive which causes an electric charge on the X-ray absorbing bodies in cooperation with the X-ray absorbing bodies.

The additive acts as a charging medium which applies an electric charge to the X-ray absorbing bodies, so that the suspension is electrostatically stabilized. For example, nitric acid is added to a mixture of methanol and polyvinyl acetate, acting as the suspension liquid, whose viscosity is chosen by way of a mixing ratio. Notably aluminium oxide grains are suitable for suspension in this suspension liquid with nitric acid acting as a charging medium. A stable suspension of lead oxide and/or lead sulphide grains provided with a polyalkylmethacrylate or Viscoplex-3™ coating is formed in Shellsol™ whereto ASA-3™ (an antistatic agent containing an organic chromium salt) is added as a charging medium. A further stable suspension is formed by providing X-ray absorbing grains with a nitrocellulose coating, by using acetone as the suspension liquid, and by adding a sulphate or aluminiumoxalate as the charging medium.

A further preferred embodiment of an X-ray examination apparatus according to the invention is characterized in that the filter comprises a filter layer with the electrically charged X-ray absorbing bodies in the X-ray transparent medium and also a plurality of electrodes which define the filter members and are coupled to the adjusting circuit.

By activation of the electrodes, i.e. by application of an electric voltage, an electric field is adjusted which influences the X-ray absorbing bodies. Charged X-ray absorbing bodies collect in the vicinity of the excited electrodes by electrophoretic deposition. In the vicinity of the excited electrodes the number of charged X-ray absorbing bodies in the X-ray transparent medium increases relative to the concentration of X-ray absorbing bodies in the vicinity of electrodes which are not excited. Each of the electrodes defines a part of the filter layer with the charged X-ray absorbing bodies acting therein as a filter member. The concentration of charged X-ray absorbing bodies in such a filter member, or in other words in the vicinity of an electrode, is dependent on the voltage applied to the relevant electrode. The X-ray absorptivity of such a filter member is, therefore, adjustable by adjustment of the voltage on the electrode of the filter member.

The electrodes are provided on a substrate, for example as a structured metal layer. Such electrodes, and hence also the filter members, have small dimensions, for example 0.5 mm×0.5 mm or 0.2×0.2 mm, and the distance between two adjacent electrodes is smaller the dimensions of the electrodes themselves. Because no macroscopic mechanically movable parts are concerned but X-ray absorbing bodies or particles which move over short distances, viz. a part of approximately the distance between two adjacent electrodes, the setting of the X-ray absorptivities of the filter members can be changed within a brief period of time, for example within one or a few seconds. The setting of the filter members is changed by changing the voltages applied to the electrodes. Changing over to changed voltages requires very little time, for example a few milliseconds. Subsequently, X-ray absorbing bodies leave no longer excited electrodes so as to move in the X-ray transparent medium, and X-ray absorbing bodies in the X-ray transparent medium collect in the vicinity of electrodes activated after changing over. The electrodes acting as an anode in collecting X-ray absorbing bodies are preferably made of a noble metal. Such materials offer the advantage that they do not tend to dissolve in the suspension liquid for as long as they are excited.

A further preferred embodiment of an X-ray examination apparatus according to the invention is characterized in that the filter comprises a filter unit in which the electrodes are provided on a substrate on which the X-ray transparent medium is provided.

The electrodes are preferably provided on a substrate as a pattern of metal tracks and metal surfaces. Using, for example, lithographic techniques, such a pattern can be provided with small details when, for example, the electrodes are not larger than 0.5 mm×0.5 mm; in order to realise a high-resolution filter, the dimensions of the electrodes are, for example 0.2 mm×0.2 mm. On the substrate there may also be provided, for example voltage leads and control leads which occupy little surface area and are arranged to excite the electrodes for the various filter settings. The electrodes and the control leads are provided, for example in a matrix arrangement. Notably lithographic techniques are suitable for forming electrodes of the desired small dimensions.

A further preferred embodiment of an X-ray examination apparatus according to the invention is characterized in that the filter comprises a filter unit in which the electrodes are provided on both sides of a substrate, and that the X-ray transparent medium is provided on both sides of the substrate with the electrodes.

Each of the electrodes on each side of the substrate influences a respective part, for example half, of the X-ray absorbing bodies. In order to change the setting of the filter, the voltages applied to the electrodes are changed. Due to the changed voltages, concentrations of X-ray absorbing bodies are simultaneously displaced from one filter member to the other by electrophoresis in the X-ray transparent medium on both sides of the substrate. The period of time required for the displacement of a given number of X-ray absorbing bodies is reduced in that the displacement of X-ray absorbing bodies takes place on both sides of the substrate simultaneously.

A further preferred embodiment of an X-ray examination apparatus according to the invention is characterized in that the filter comprises a plurality of said filter units which are consecutively arranged.

A filter unit comprises a substrate on which there are provided the electrodes and the X-ray transparent medium containing the X-ray absorbing bodies. In each filter member the maximum X-ray absorptivity is reached by collecting a maximum concentration of X-ray absorbing bodies across the entire thickness of the filter layer in the relevant filter member. The maximum X-ray absorptivity of the filter unit is determined by the thickness of the X-ray transparent medium containing the suspension of X-ray absorbing bodies, by the maximum concentration of X-ray absorbing bodies in the vicinity of an electrode, i.e. in a filter member, and by the specific X-ray absorptivity of the X-ray absorbing material. The maximum X-ray absorptivity of a filter comprising a plurality of consecutively arranged filter units amounts to the sum of the X-ray absorptivities of each of the filter units. The maximum X-ray absorptivity of the filter is increased by using a plurality of filter members in a consecutive arrangement.

A setting of a filter comprises a plurality of consecutively arranged filter units is changed in that the change occurs simultaneously in all filter units. In each filter unit a slight amount of X-ray absorbing bodies is then displaced by electrophoresis between filter members in each filter unit. The adjustment time of a filter member is shorter as the number of X-ray absorbing bodies to be displaced in the relevant filter member is smaller. By utilizing a plurality of filter members it is achieved that the filter setting is changed by simultaneously displacing X-ray absorbing bodies within different filter members. Consequently, the time required to change the filter setting by displacing a given number of X-ray absorbing bodies is reduced when a filter according to the invention is constructed so as to comprise a plurality of consecutively arranged filter members.

A further preferred embodiment of an X-ray examination apparatus according to the invention is characterized in that the filter comprises a reservoir, connected to the filter layer, for the X-ray absorbing bodies in the X-ray transparent medium and a pump for circulating the X-ray transparent medium with the X-ray absorbing bodies through the filter layer.

The maximum X-ray absorptivity in a filter member is achieved by collecting X-ray absorbing bodies with the maximum density across the full thickness of the filter layer in the relevant filter member. An adequate amount of X-ray absorbing bodies must be available so as to achieve a substantial maximum X-ray absorptivity. If substantially all X-ray absorbing bodies available in the X-ray transparent medium, formed by the suspension liquid, of the filter layer were to collect in the vicinity of electrodes, the suspension would become exhausted. Such exhaustion is avoided by providing a reservoir with suspension and by circulating this suspension through the filter layer. While X-ray absorbing bodies collect in the vicinity of the excited electrodes, X-ray absorbing bodies continue to arrive in the circulating suspension from the reservoir. Because of the presence of a reservoir in which large amounts of X-ray absorbing bodies are kept available, the X-ray transparent medium may have a small layer thickness, so that the X-ray absorption near non-excited electrodes and in areas of the filter layer which do not adjoin an electrode remains low. The X-my transparent medium with the X-ray absorbing bodies is circulated through the filter layer and the reservoir by means of the pump. For circulation it is particularly attractive to use an X-ray transparent medium in the form of a suspension liquid in which the X-ray absorbing bodies are suspended.

A further preferred embodiment of an X-ray apparatus according to the invention is characterized in that the reservoir is provided with a mixing device for stirring up the X-ray absorbing bodies in the X-ray transparent medium.

Even though the suspension of X-ray absorbing bodies in the suspension liquid is colloidal chemically stable, the filter is further improved by providing the reservoir with a mixing device for eliminating any settling out of the suspension by stirring up the suspension from time to time.

BRIEF DESCRIPTION OF THE DRAWINGS

The invention will be described in detail hereinafter on the basis, of the following embodiments and the attached drawings, wherein.

DETAILED DESCRIPTION OF THE PREFERRED EMBODIMENTS

Figure 1:
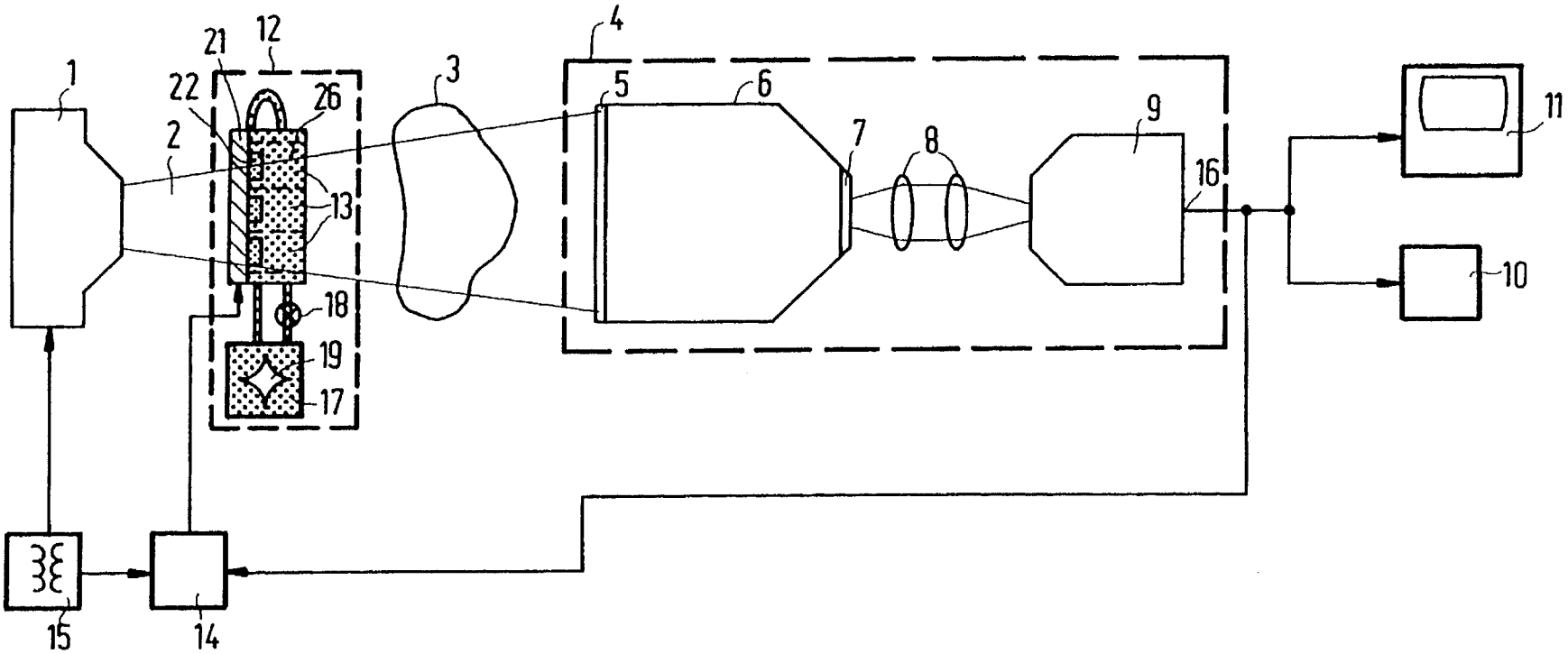
FIG. 1 shows diagrammatically an X-ray examination apparatus comprising a filter according to the invention.

FIG. 1 shows diagrammatically an X-ray examination apparatus comprising a filter according to the invention. The X-ray source 1 emits an X-ray beam 2 whereby an object 3, for example a patient to be examined, is irradiated. Due to absorption of X-rays in the object 3, an X-ray image is formed on the X-ray detector 4 which is in this case formed by an image intensifier/pick-up chain. The X-ray image is formed on the entrance screen 5 of the X-ray image intensifier 6 and is converted on the exit window 7 into a light image which is imaged onto the camera 9 by means of a lens system 8. The camera 9 forms an electronic image signal from the light image. For example, for further processing the electronic image signal is applied to an image processing unit 10 or to a monitor 11 on which the image information in the X-ray image is visualized.

Between the X-ray source 1 and the object 3 there is arranged a filter 12 for locally attenuating the X-ray beam 2 by means of several filter members 13 whose X-ray absorptivity can be adjusted by means of the adjusting circuit 14. The filter contains a suspension of electrically charged X-ray absorbing bodies in suspension liquid, for example plumbiferous grains or powder particles of a diameter of one or a few μm which collect, by electrophoresis under the influence of an adjusted electric field, in filter members adjusted for a high X-ray absorptivity. The plumbiferous (leaded) grains, such as lead oxide glass grains provided with a nitrocellulose coating, are suspended, for example in acetone. The electric field is adjusted by the adjusting circuit 14 on the basis of, for example brightness values of the X-ray image and/or on the basis of the setting of the X-ray source; to this end, the adjusting circuit is connected to the power supply 15 of the X-ray source and to the output terminal 16 of the camera 9. The filter members are adjusted in respect of X-ray absorptivity by the adjusting circuit, the brightness values of the X-ray image being within a predetermined range, for example in conformity with the range of brightness values of the light image that can be processed by the camera 9 without disturbing the electronic image signal. Filter members traversed by a part of the X-ray beam which is strongly attenuated by the object are adjusted for a low X-ray absorptivity whereas filter members which are traversed by a part of the X-ray beam which is suitably transmitted by the object are adjusted for a low X-ray absorptivity.

The filter layer 26 is connected to a reservoir 17 containing a quantity of the suspension. The suspension is circulated through the filter layer 26 by a pump 18. When the filter members are adjusted for a high X-ray absorptivity, requiting large quantities of the plumbiferous grains, exhaustion of the suspension is avoided in that plumbiferous grains are fed from the reservoir. The suspension is colloidal chemically stabilized, inter alia because the plumbiferous grains are provided with a nitrocellulose coating. Settling out of the suspension is also prevented by means of a mixing device 19 in the reservoir which stirs up the suspension, if necessary. In the present embodiment the mixing device 19 is formed by a blade wheel which can rotate so as to stir up the suspension.

Figure 2A:
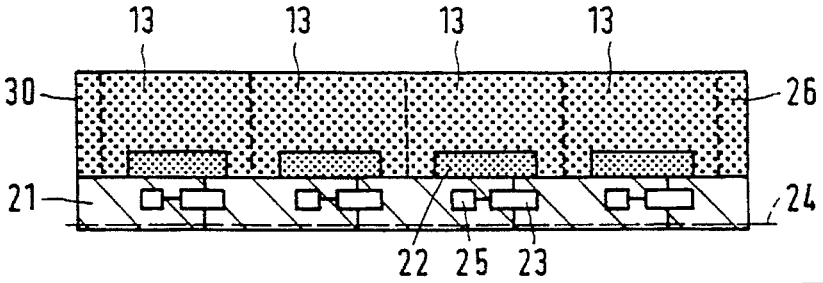
FIG. 2*a* is a diagrammatic sectional view of a first embodiment of a filter unit for the filter of the X-ray examination apparatus shown in FIG. 1.

The filter 12 may comprise one or more filter units. FIG. 2*a* is a diagrammatic cross-sectional view of a first embodiment of a filter unit 30 for the filter of the X-ray examination apparatus shown in FIG. 1. The filter unit 30 comprises the substrate 21 on which there are provided a number of electrodes 22 which are coupled, via switches 3, to voltage leads 24 which couple the electrodes 22 to the adjusting circuit 14. The switches 23 are controlled via control leads 25 which are also coupled to the adjusting circuit. On the substrate 21 with the electrodes 22 there is provided the filter layer 26 with suspended plumbiferous grains. Each of the electrodes defines a part of the filter layer 26 as a filter member 13. In filter members with an electrode whereto a voltage is applied, the X-ray absorptivity is increased in that under the influence of electrophoresis plumbiferous grains from the suspension collect in the vicinity of these electrodes. The electrodes have dimensions of, for example no more than 0.5 mm×0.5 mm; in order to achieve a high-resolution filter, the dimensions of the electrodes are, for example 0.2 mm×0.2 mm. The adjusting circuit 14 adjusts the voltage applied to the electrodes 22, and hence the electric field in the filter layer 26 which influences the plumbiferous grains.

Figure 2B:
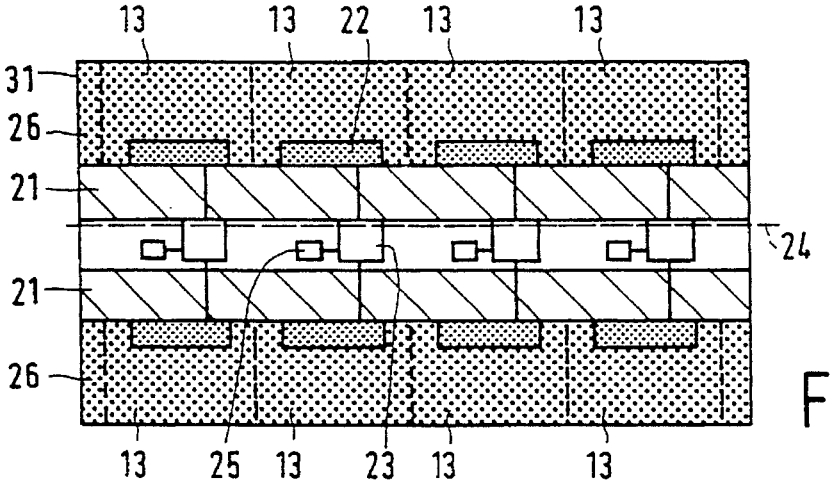
FIG. 2*b* is a diagrammatic sectional view of a second embodiment of a filter unit for the filter of the X-ray examination apparatus shown in FIG. 1.

FIG. 2*b* is a diagrammatic sectional view of a second embodiment of a filter unit 31 for the filter of the X-ray examination apparatus shown in FIG. 1. Electrodes 22 and a filter layer 26 with the plumbiferous grains in a suspension are provided on both sides of the substrate 21. The electrodes on each side of the substrate influence a respective part, for example half, of the plumbiferous grains in the suspension.

Figure 3A:
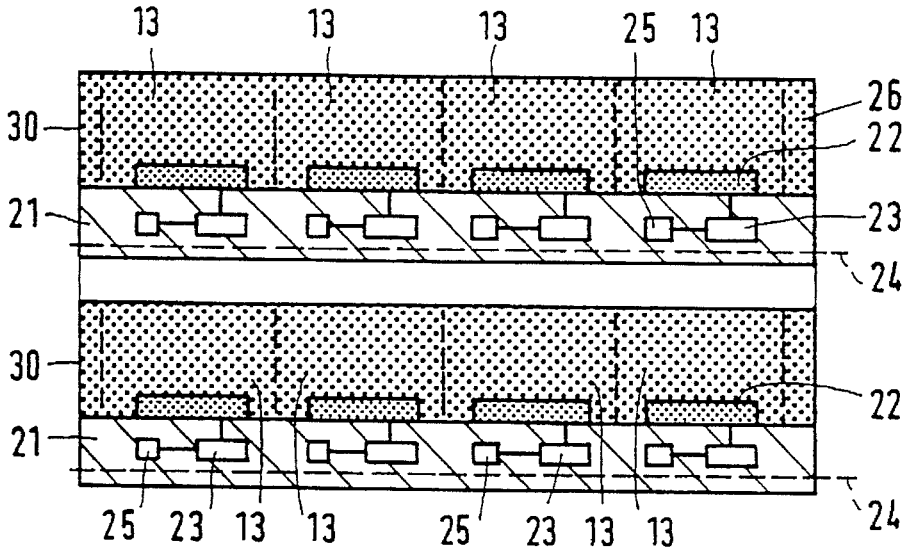
FIG. 3*a* is a diagrammatic sectional view of a first embodiment of a filter of the X-ray examination apparatus shown in FIG. 1.

FIG. 3*a* is a diagrammatic sectional view of a first embodiment of the filter 12 of the X-ray examination apparatus shown in FIG. 1. The filter 12 comprises a plurality of filter units 30, for example two of such units as shown in FIG. 3*a*, which are arranged to succeed one another in the direction of the X-ray beam.

Figure 3B:
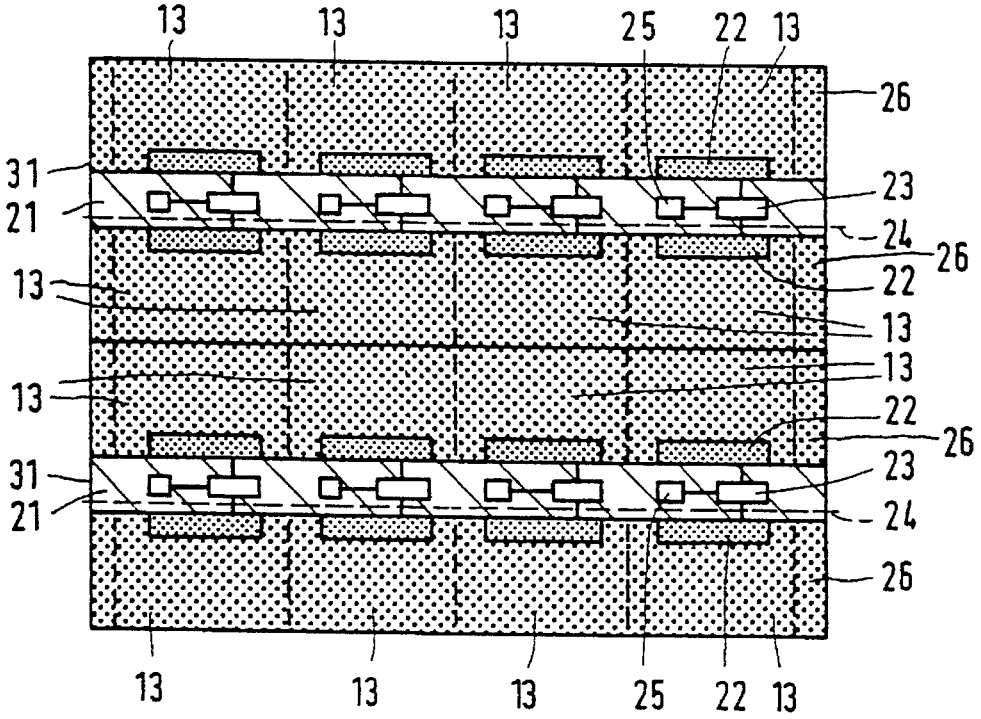
FIG. 3*b* is a diagrammatic sectional view of a second embodiment of a filter of the X-ray examination apparatus shown in FIG. 1.

FIG. 3*b* is a diagrammatic sectional view of a second embodiment of the filter 12 of the X-ray examination apparatus shown in FIG. 1. The filter 12 comprises a plurality of filter units 31, for example two as shown in FIG. 3*a*, which are arranged one behind the other in the direction of the X-ray beam.

Figure 4:
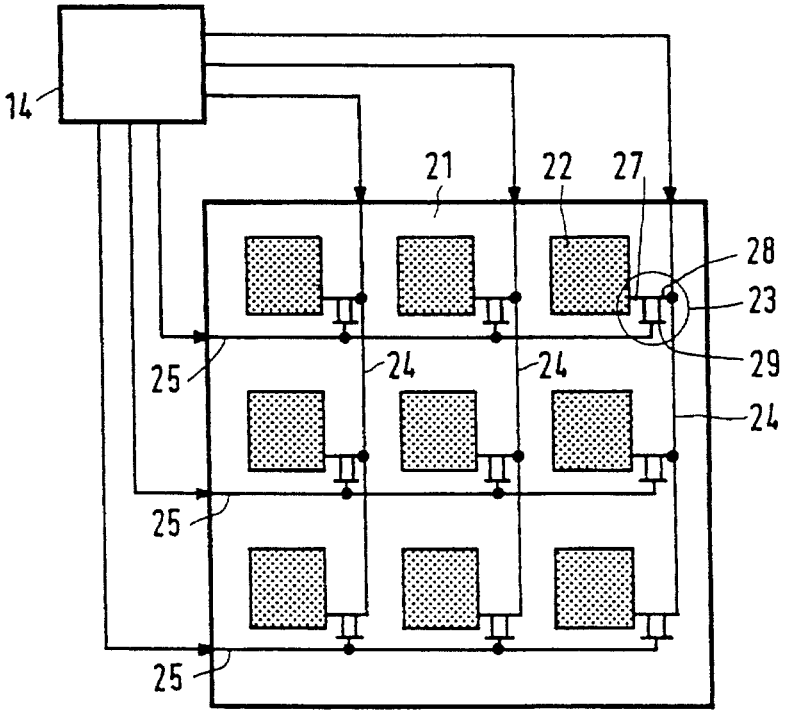
FIG. 4 is a diagrammatic plan view of a filter of the X-ray examination apparatus shown in FIG. 1.

FIG. 4 is a diagrammatic plan view of the filter of the X-ray examination apparatus shown in FIG. 1. The electrodes 22 are arranged on the substrate 21 in the form of a matrix. The Figure shows a 3×3 matrix by way of example, but in practice a matrix can be used which comprises hundreds by hundreds of small electrodes, each of which is smaller than one square min. Each electrode is coupled, by way of a switch 23, to a voltage lead 24 provided for each of the columns of electrodes. The switches 23 are, for example field effect transistors whose drain contact 27 is coupled to one of the electrodes 22, their source contact 28 being coupled to the voltage lead 24 of the relevant column. For each of the rows of electrodes there are provided control leads 25 which control the switches by applying a control voltage, via a control lead 25, to the gate contacts 29 of the field effect transistors in the relevant row. In order to apply a voltage to an electrode in a given row and column, the voltage lead of the relevant column receives a voltage and the control lead of the relevant row receives a control voltage which closes the switches in the relevant row. After a brief period of time, the control voltage is switched off so that the switches are opened and the voltage on the voltage lead is also switched off. The relevant electrode, then being electrically uncoupled from the control and voltage leads, retains the applied voltage. By successively applying a voltage column-wise to voltage leads and by applying control voltages to voltage leads for the rows, for which electrodes are activated within the relevant column, it is achieved that voltages desired for adjustment of the filter are applied to the electrodes of the entire matrix.

We claim:

1. An X-ray examination apparatus, comprising a filter which is arranged between an X-ray source and an X-ray detector and which comprises filter members having an adjustable X-ray absorptivity, characterized in that the filter comprises X-ray absorbing bodies which can be influenced by an electric field adjusted by means of an adjusting circuit.

2. An X-ray examination apparatus as claimed in claim 1, characterized in that the adjusting circuit is arranged to adjust the filter members for X-ray absorptivities for which brightness values of an X-ray image detected by the X-ray detector and formed by irradiating an object by means of an X-ray beam emitted by the X-ray source are within a predetermined range.

3. An X-ray examination apparatus as claimed in claim 1, characterized in that the adjusting circuit is arranged to derive the adjusted electric field from the brightness values of an X-ray image detected by the X-ray detector.

4. An X-ray examination apparatus as claimed in claim 1, characterized in that the adjusting circuit is also arranged to adjust an erasure field whose polarity opposes that of said adjusted electric field.

5. An X-ray examination apparatus as claimed in claim 1, characterized in that the filter contains electrically charged X-ray absorbing bodies in an X-ray transparent medium.

6. An X-ray examination apparatus as claimed in claim 5, characterized in that the X-ray absorbing bodies are provided with a coating in order to stabilize a suspension of the X-ray absorbing bodies in the X-ray transparent medium.

7. An X-ray examination apparatus as claimed in claim 5, characterized in that the X-ray transparent medium contains an additive which causes an electric charge on the X-ray absorbing bodies in cooperation with the X-my absorbing bodies.

8. An X-ray examination apparatus as claimed in claim 5, characterized in that the filter comprises a filter layer with the electrically charged X-ray absorbing bodies in the X-my transparent medium and also a plurality of electrodes which define the filter members and are coupled to the adjusting circuit.

9. An X-ray examination apparatus as claimed in claim 8, characterized in that the filter comprises a filter unit in which the electrodes are provided on a substrate on which the X-ray transparent medium is provided.

10. An X-ray examination apparatus as claimed in claim 8, characterized in that the filter comprises a filter unit in which the electrodes are provided on both sides of a substrate, and that the X-ray transparent medium is provided on both sides of the substrate with the electrodes.

11. An X-ray examination apparatus as claimed in claim 9, characterized in that the filter comprises a plurality of filter units which are arranged to succeed one another.

12. An X-ray examination apparatus as claimed in any one of the claim 8, characterized in that the filter comprises a reservoir, connected to the filter layer, for the X-ray absorbing bodies in the X-ray transparent medium, and a pump for circulating the X-ray transparent medium with the X-ray absorbing bodies through the filter layer.

13. An X-ray examination apparatus as claimed in claim 12, characterized in that the reservoir is provided with a mixing device for stirring up the X-ray absorbing bodies in the X-ray transparent medium.

14. An X-ray examination apparatus as claimed in claim 2, characterized in that the adjusting circuit is arranged to derive the adjusted electric field from the brightness values of an X-ray image detected by the X-ray detector.

15. An X-ray examination apparatus as claimed in claim 2, characterized in that the adjusting circuit is also arranged to adjust an erasure field whose polarity opposes that of said adjusted electric field.

16. An X-ray examination apparatus as claimed in claim 3, characterized in that the adjusting circuit is also arranged to adjust an erasure field whose polarity opposes that of said adjusted electric field.

17. An X-ray examination apparatus as claimed in claim 2, characterized in that the filter contains electrically charged X-ray absorbing bodies in an X-ray transparent medium.

18. An X-ray examination apparatus as claimed in claim 3, characterized in that the filter contains electrically charged X-ray absorbing bodies in an X-ray transparent medium.

19. An X-ray examination apparatus as claimed in claim 4, characterized in that the filter contains electrically charged X-ray absorbing bodies in an X-ray transparent medium.

20. An X-ray examination apparatus as claimed in claim 17, characterized in that the X-ray absorbing bodies are provided with a coating in order to stabilize a suspension of the X-ray absorbing bodies in the X-ray transparent medium.

* * * * *